US007757309B2

(12) United States Patent
Schimpf

(10) Patent No.: US 7,757,309 B2
(45) Date of Patent: Jul. 20, 2010

(54) PROTECTIVE HELMET

(75) Inventor: Oliver Schimpf, Braunschweig (DE)

(73) Assignee: Schuberth GmbH, Magdeburg (DE)

( * ) Notice: Subject to any disclaimer, the term of this patent is extended or adjusted under 35 U.S.C. 154(b) by 203 days.

(21) Appl. No.: 11/576,567

(22) PCT Filed: Sep. 29, 2005

(86) PCT No.: PCT/DE2005/001745

§ 371 (c)(1),
(2), (4) Date: Apr. 3, 2007

(87) PCT Pub. No.: WO2006/037295

PCT Pub. Date: Apr. 13, 2006

(65) Prior Publication Data

US 2008/0072364 A1 Mar. 27, 2008

(30) Foreign Application Priority Data

Oct. 4, 2004 (DE) ..... 10 2004 048 842

(51) Int. Cl.
*A42B 1/08* (2006.01)

(52) U.S. Cl. ..... 2/424; 2/410

(58) Field of Classification Search ..... 2/410, 2/424, 15, 9, 12
See application file for complete search history.

(56) References Cited

U.S. PATENT DOCUMENTS 3,239,843 A * 3/1966 Lobelle ..... 2/6.4
3,748,657 A * 7/1973 Aileo ..... 2/6.4
4,297,747 A * 11/1981 Nava ..... 2/424
6,249,918 B1 * 6/2001 Lacroix ..... 2/424
6,442,767 B1 * 9/2002 Meckes et al. ..... 2/424
6,959,989 B2 * 11/2005 Holm ..... 351/155

FOREIGN PATENT DOCUMENTS

| | | |
|---|---|---|
| DE | 4416921 | 11/1995 |
| DE | 10115180 | 12/2002 |
| EP | 0603027 | 6/1994 |
| EP | 1393642 | 3/2004 |

* cited by examiner

*Primary Examiner*—Shaun R Hurley
*Assistant Examiner*—Andrew W Sutton
(74) *Attorney, Agent, or Firm*—Whitham Curtis Christofferson & Cook, PC

(57) ABSTRACT

A protective helmet having a shock-resistant helmet shell having a cut out for establishing a visor opening and a visor panel arranged on the outer side of the helmet shell pivotably around a pivot joint is provided with a vison panel arranged pivotably on the inner side of the helmet shell. The vision panel has at least one lateral end mounted displaceably in a guide which forma a curved section whose virtual pivot point lies outside the lateral end at a distance behind the lateral end of the vision panel so that the path of movement of the vision panel matches to the inner contour of the helmet shell. This makes possible to guide the vision panel inside the helmet shell at a substantially uniform distance from the inner side of the helmet shell, with the result that a minimum space requirement for the vision panel is required on the inner side of the helmet shell. At least one lateral end, preferably both lateral ends, of the vision panel may be connected to a Bowden cable, the other end of which cable is coupled to an actuating element arranged on the outer side of the helmet shell.

5 Claims, 4 Drawing Sheets

PROTECTIVE HELMET

BACKROUND OF THE INVENTION

1. Field of the Invention

The invention relates to a protective helmet with a shock-resistant helmet shell, which has a cutout for a visor opening, and with a vision panel, in particular a sunshield, which is arranged pivotably on the inner side of the helmet shell and which can be pivoted from an inoperative position in which it uncovers the visor opening into an end position in which it projects into the visor opening.

2. Related Art

Such a protective helmet is known, for example, through the Schuberth "Concept" helmet developed and marketed by the applicant. In this helmet, an outer visor panel which completely covers the visor opening is pivotally mounted on the outer side of the helmet shell. By contrast, the sunshield is arranged on the inner side of the helmet shell, that is to say between the shock-resistant helmet shell and a shock-damping inner shell. The sunshield here is likewise able to pivot about pivot joints arranged at its lateral ends. The pivoting movement is controlled by a slide which is mounted on the outer side of the helmet shell and which acts directly on a lateral end of the sunshield. Since the pivoting movement of the sunshield does not correspond to the aerodynamically determined contour of the protective helmet in the direction of travel, the space required to accommodate the sunshield in the inoperative position must allow for a certain distance between an edge of the sunshield and the inner side of the helmet shell. In order, nevertheless, to ensure sufficient damping by the damping inner shell, a certain increase in volume—and thus in weight—of the protective helmet must be accepted with regard to mounting the sunshield.

DE 44 16 921 A1 also discloses mounting the sunshield in the visor frame of the visor panel, with the result that the sunshield too is mounted on the outer side of the helmet shell, specifically by means of pivot joints situated on the visor frame. This embodiment has the disadvantage that it is not possible to use the sunshield when the visor is swung up. Furthermore, a very space-consuming visor frame results. Moreover, in the event of the visor becoming damaged, replacement is very complicated since the mechanism for holding the sunshield has to be replaced as well.

SUMMARY OF THE INVENTION

The object on which the present invention is based is to equip a protective helmet with a sunshield in which the additional space requirement for the sunshield is minimal.

This object is achieved according to the invention in a protective helmet of the initially mentioned type in that the vision panel has at least one lateral end mounted displaceably in a guide which forms a curved section whose virtual pivot point lies outside the lateral end and at a distance behind the lateral end of the vision panel.

According to the invention, at least one guide in which a lateral end of the helmet shell is mounted is provided on the inner side of the helmet shell. The guide forms a curved section whose virtual pivot point formed by the respective radius lies outside the lateral end of the vision panel. As a result, the virtual pivot point is shifted significantly behind the lateral end of the vision panel, resulting in an effective radius which can be tailored to the radius of the helmet shell. This makes it possible to guide the vision panel inside the helmet shell at a substantially uniform distance from the inner side of the helmet shell, with the result that a minimum space requirement for the vision panel is required on the inner side of the helmet shell. It is preferred here for both ends of the vision panel to be guided in an associated guide so that the vision panel can be guided reliably without the risk of distortions and deformations.

The virtual pivot point of the guide can move during the movement of the vision panel if the helmet shell does not have a circular shape above the visor opening in the plane formed by the longitudinal center plane of the helmet.

The minimized space requirement for accommodating the vision panel allows a reduction in the wall thickness of the shock-damping inner shell in the forehead region of the crash helmet, thereby permitting a reduction in volume and a reduction in weight.

The vision panel mounted according to the invention can be actuated in a conventional manner by means of a slide which can be moved from the outer side of the helmet shell and which is arranged in the region of a lateral end of the vision panel, that is to say approximately in the ear region of the helmet shell.

In a preferred embodiment, however, at least one lateral end, preferably both lateral ends, of the vision panel is or are connected to a Bowden cable, the other end of which cable is coupled to an actuating element arranged on the outer side of the helmet shell. The actuating element here is preferably seated on a chin part connected to the helmet shell, if the helmet shell is an integral helmet with such a chin part. In this case, the actuating element by virtue of its advantageous arrangement can be operated easily by the motorcyclist and without him having to feel around much.

The invention will be explained in more detail below with reference to exemplary embodiments represented in the drawing, in which:

DETAILED DESCRIPTION OF THE PREFERRED EMBODIMENTS OF THE INVENTION

Figure 1:
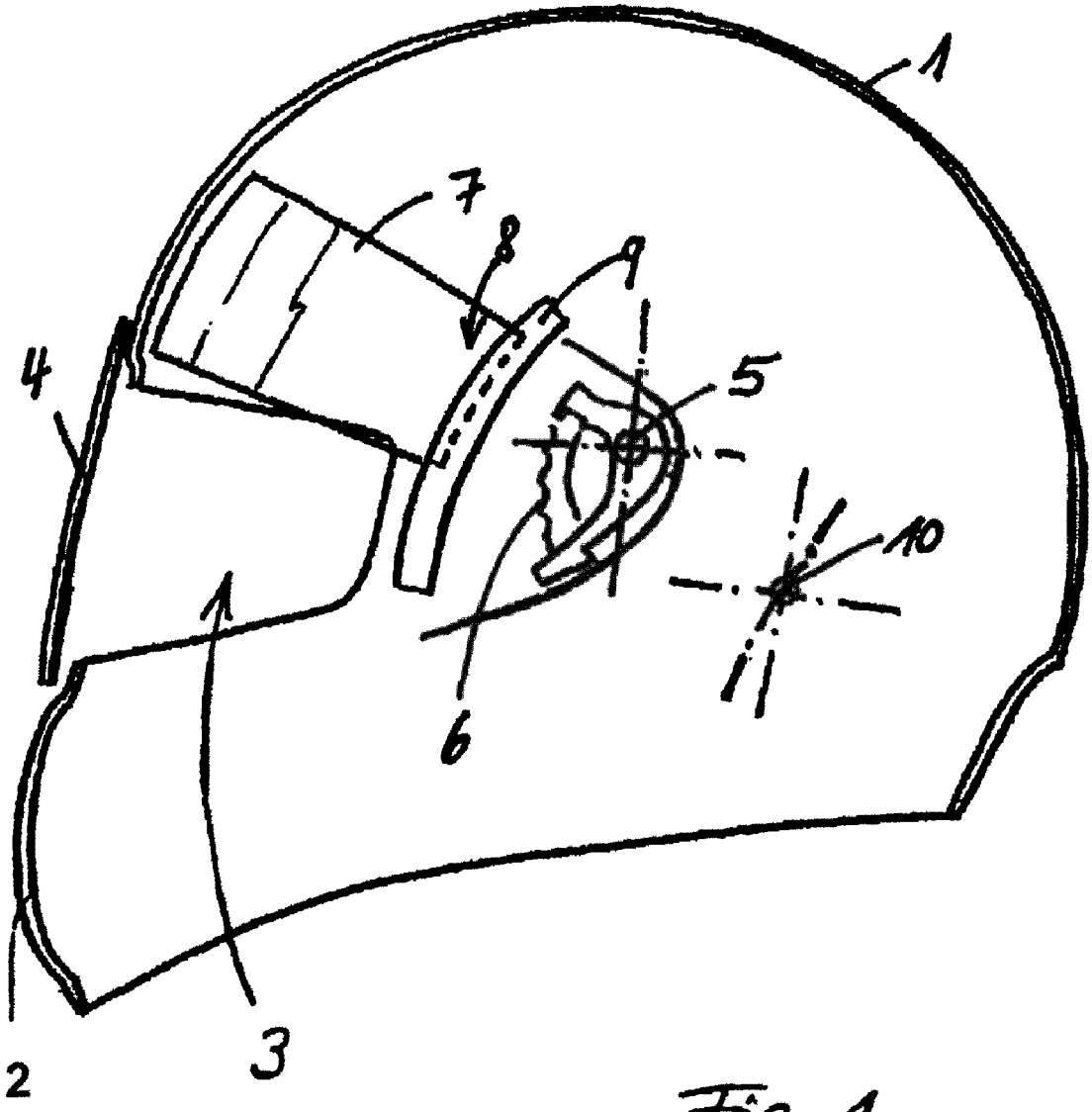
FIG. 1 shows a schematic representation of a section through a protective helmet according to the invention taken through the longitudinal center axis of the protective helmet.

The protective helmet represented in FIG. 1 comprises a helmet shell 1 for an integral helmet, i.e. one with a chin part 2. A cutout in the helmet shell forms a visor opening 3 which can be closed off (and which is shown to be closed off in FIG. 1) by means of a visor panel 4 arranged pivotably on the outer side of the helmet shell 1. A pivot joint 5 of the visor panel 4 is indicated schematically in FIG. 1 with a locking mechanism 6, which allows the visor panel to be latched not only in the completely opened and completely closed position but also in a number of intermediate positions.

A vision panel 7 in the form of a sunshield is mounted on the inner side of the helmet shell 1 above the visor opening 3 and is preferably curved spherically to match the inner contour of the helmet shell 1 in this region. This vision panel 7 can be pivoted from the inoperative position represented in FIG. 1, in which it is situated completely behind the forehead region of the helmet shell 1, downwardly into the region of the visor opening 3. For this purpose, lateral ends 8 of the visor panel are mounted in a respective guide 9. The guide 9 forms a curved section which is curved so as to produce a virtual pivot point 10 which lies not only outside the lateral ends 8 of the vision panel 7 but also at a considerable distance from the guide 9. This makes it possible to match the path of movement of the vision panel 7 exactly to the inner contour of the helmet shell 1 in the region above the visor opening 3 and to achieve a desired positioning of the vision panel 7 within the visor opening when the vision panel 7 is in the swung-down state. If required, the curved section of the guide 9 can deviate from a circular arc section, with the result that the virtual pivot point 10 can move somewhat during the pivoting movement of the vision panel 7, although still remaining far outside the lateral ends 8 of the vision panel 7 and being arranged at a considerable distance behind the guide 9.

Figure 2:
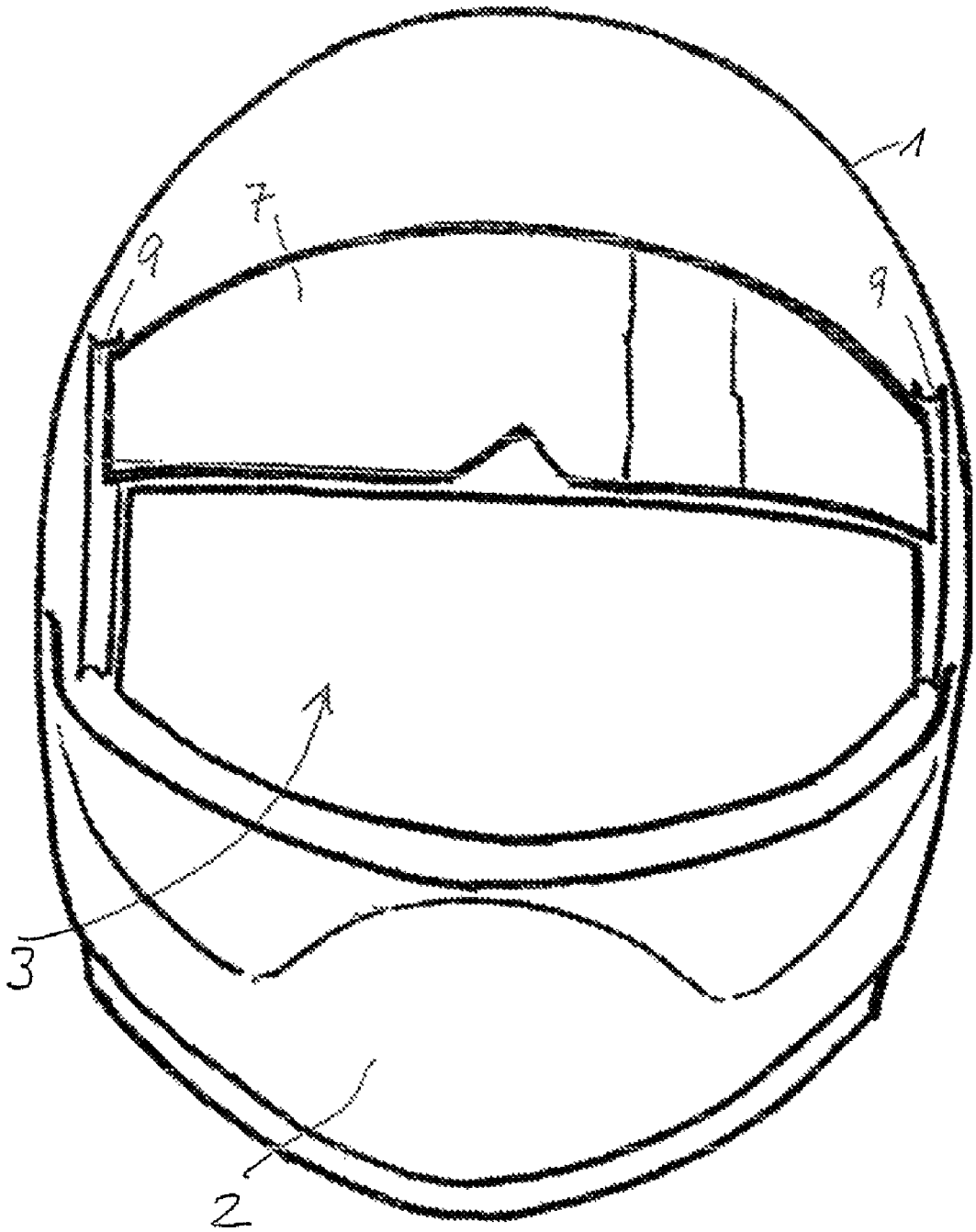
FIG. 2 shows a front view of the protective helmet according to FIG. 1 with a vision panel in an inoperative position.
Figure 3:
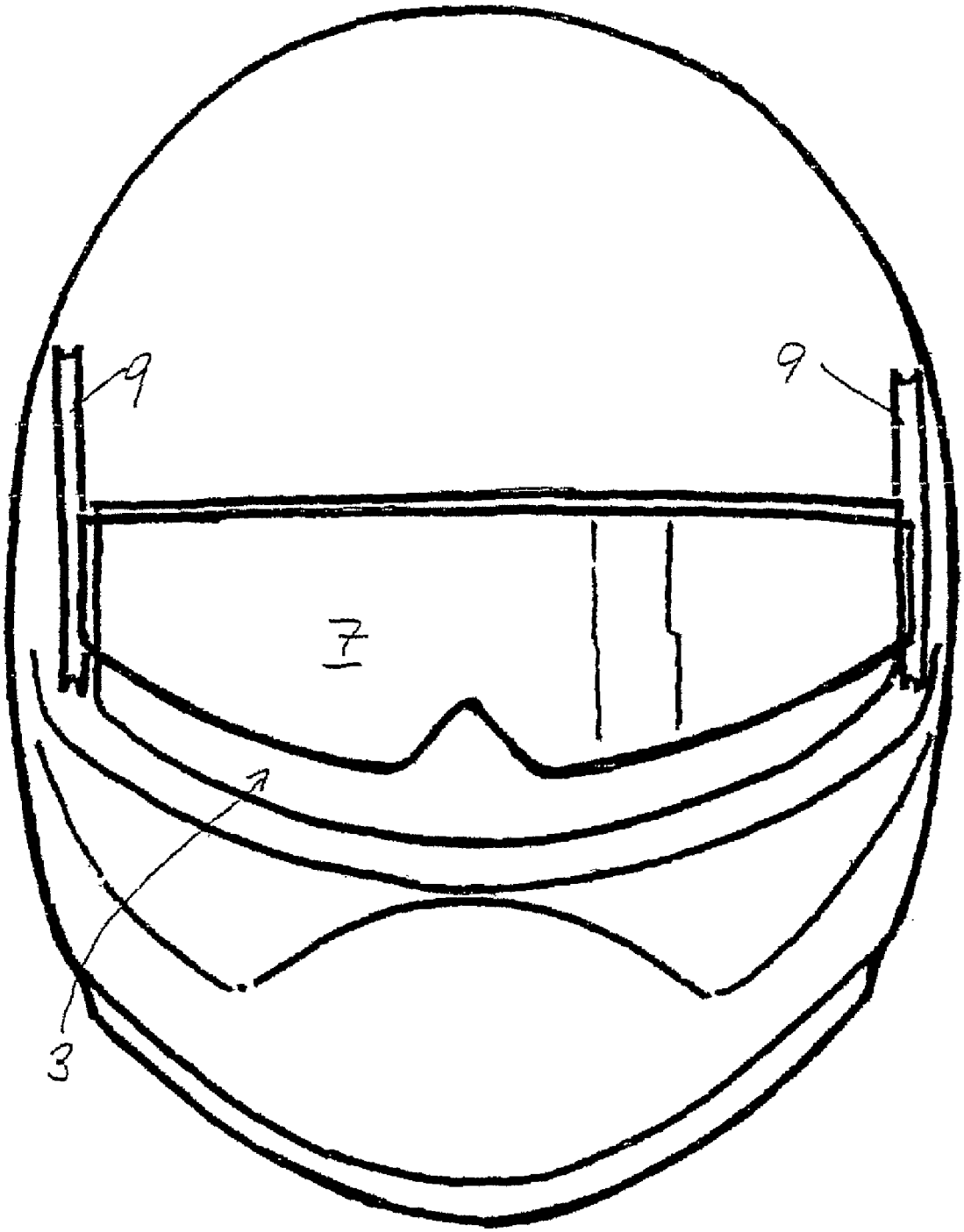
FIG. 3 shows the front view according to FIG. 2 with the vision panel in a lower end position.

FIGS. 2 and 3 schematically illustrate a front view of the protective helmet according to FIG. 1, with the vision panel 7 being represented above the visor opening 3 in the inoperative position in FIG. 2, whereas the vision panel 7 in the representation of FIG. 3 is situated in the lower end position, that is to say in a maximum use position. Of course, it is possible for the motorcyclist to select any desired intermediate positions to suit him. For this purpose, the arrangement for mounting the vision panel 7 in the guides 9 can be designed to be sufficiently self-locking.

Figure 4:
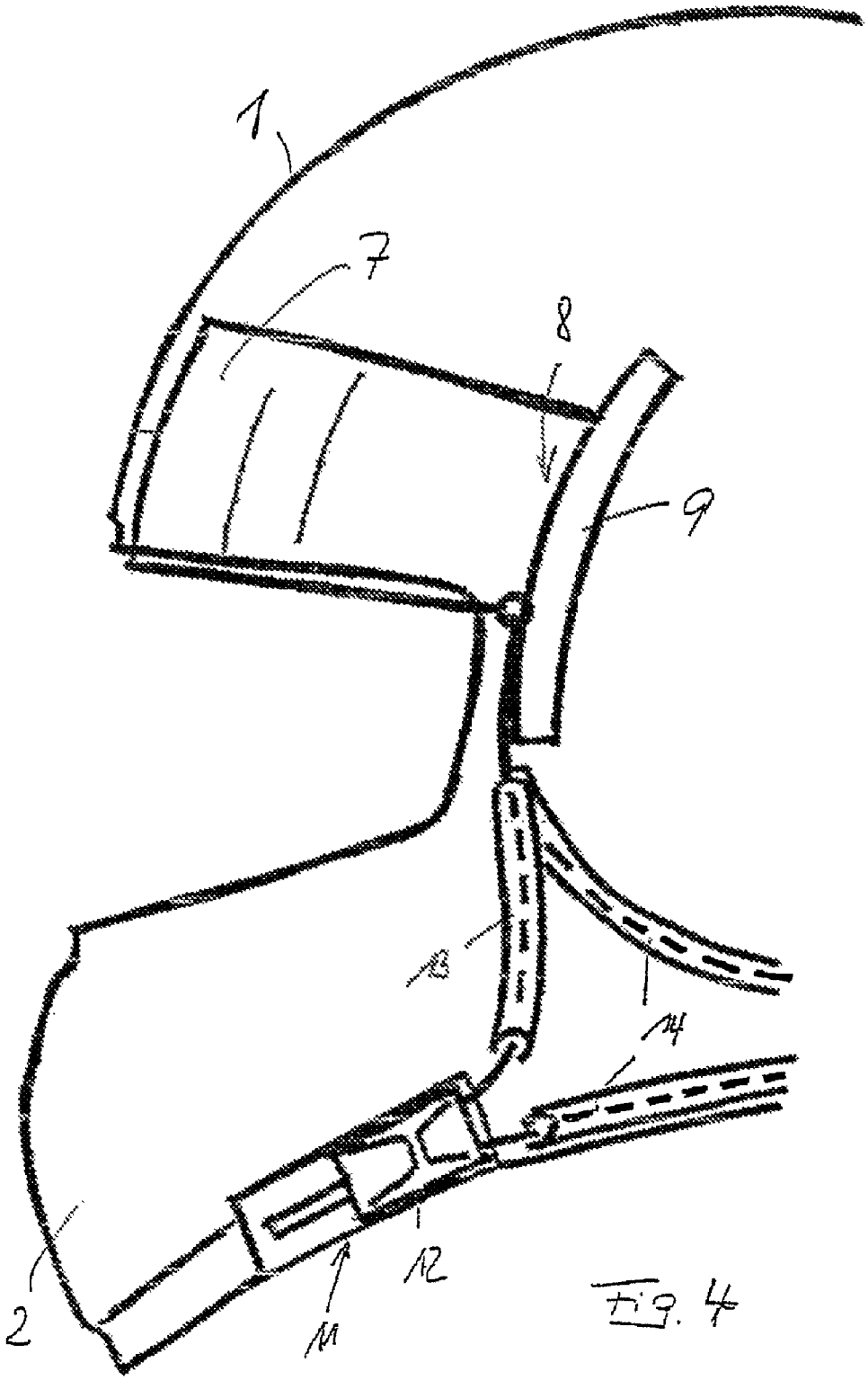
FIG. 4 shows a schematic representation of the actuation of the vision panel by means of an actuating element arranged laterally on the chin part.

FIG. 4 schematically shows, in a side view, a variant of the embodiment according to FIG. 1, in which variant both lateral ends 8 of the vision panel 7 are actuated by means of an actuating element 11 which is arranged laterally on the chin part 2 of the helmet shell and which is formed as a slide 12 which can be displaced substantially parallel to the lower edge of the helmet shell 1. Coupled to the actuating element 11 are two Bowden cables 13, 14, of which the shorter Bowden cable 13 extends to the left-hand lateral end 8 of the vision panel 7 and the longer Bowden cable 14, which is guided around the rear neck region of the helmet on the inner side and lower edge of the helmet shell 1, extends to the right-hand lateral end 8 of the vision panel 7. As a result, the same actuating movement on the actuating element 11 causes both lateral ends 8 of the vision panel 7 to be moved synchronously upward or downward in their respective guide 9. In addition to the actuation of the vision panel 7 thus being produced on both sides and preventing distortion and jamming, reliable and rapid actuation is also achieved because the actuating element 11 is seated at a point which the motorcyclist can find very easily and without having to feel around much.

The invention claimed is:

1. A protective helmet comprising:

a shock-resistant helmet shell having a cutout for a visor opening, and a visor panel arranged on the outer side of the helmet shell which is connected to and pivots around a pivot joint, wherein a vision panel is arranged pivotably on the inner side of the helmet shell so as to be pivotable from an inoperative position in which it uncovers the visor opening into an end position in which it projects into the visor opening, the vision panel has at least one lateral end mounted displaceably in a guide and the guide forms a curved section whose virtual pivot point lies outside and at a distance behind the lateral end of the vision panel so that the path of movement of the vision panel matches to the inner contour of the helmet shell.

2. The protective helmet as claimed in claim 1, characterized in that the guide is shaped in such a way that the pivot point moves during the movement of the vision panel.

3. The protective helmet as claimed in claim 1, characterized in that both lateral ends of the vision panel are mounted displaceably in a respective guide.

4. The protective helmet as claimed in claim 1, characterized in that at least one lateral end of the vision panel is connected to a Bowden cable, the other end of which is coupled to an actuating element arranged on the outer side of the helmet shell.

5. The protective helmet as claimed in claim 4, characterized in that the actuating element is arranged laterally on a chin part connected to the helmet shell.

* * * * *